US005838287A

United States Patent [19]

Kuijk

[11] Patent Number: 5,838,287

[45] **Date of Patent: *Nov. 17, 1998**

[54] LIQUID CRYSTAL DISPLAY PANEL HAVING CIRCUITRY FOR REDUCING THE MUTUAL INFLUENCE OF PIXELS CONNECTED TO SELECTION ADDRESS CONDUCTORS

[75] Inventor: Karel E. Kuijk, Eindhoven, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 742,283

[22] Filed: Oct. 31, 1996

Related U.S. Application Data

[63] Continuation of Ser. No. 519,559, Aug. 25, 1995, abandoned.

[30] Foreign Application Priority Data

Sep. 1, 1994 [EP] European Pat. Off. ..... 94202499

[51] Int. Cl.[6] ..... G09G 3/20

[52] U.S. Cl. ..... 345/58; 345/98

[58] Field of Search ..... 345/87, 91, 92, 345/94, 95, 96, 101, 104, 55, 58, 50, 51, 52, 211, 212; 359/54, 60, 58, 86

[56] References Cited

U.S. PATENT DOCUMENTS 5,014,048 5/1991 Knapp ..... 345/91
5,434,588 7/1995 Parker ..... 345/98
5,457,474 10/1995 Ikeda ..... 345/92
5,489,910 2/1996 Kuwata et al. ..... 345/212

FOREIGN PATENT DOCUMENTS 0523796 1/1993 European Pat. Off. .

*Primary Examiner*—Chanh Nguyen
*Attorney, Agent, or Firm*—Edward W. Goodman

[57] ABSTRACT

A liquid crystal display device (LCD) includes sets of row address conductors (10) and column address conductors (11) which are coupled to liquid crystal pixels (12) arranged in a matrix of rows and columns for displaying images. A drive circuit (20–24) for such a display device generates selection voltages (Vr) to be supplied to one of the sets of address conductors (10, 11), and data voltages (Vk) to be supplied to the other set of address conductors (10, 11), the data voltages (Vk) being related to a received display information signal (VI). To reduce a mutual influence of the pixels connected to the selection address conductor, which influence is caused by charge currents flowing via a common impedance arranged in series with the selection address conductor, the drive circuit (20–24) further includes an averaging circuit (23) for generating a correction signal (C) and for averaging an information signal (Im) related to the display information signal (VI) over an averaging period which is related to a line period of the information signal (Im). The drive circuit (20–24) is further provided with a voltage correction circuit (22) for generating at least a power supply voltage (CV) corrected in dependence upon a correction signal (C) to be supplied to at least one of the sets of address conductors (10, 11).

7 Claims, 2 Drawing Sheets

LIQUID CRYSTAL DISPLAY PANEL HAVING CIRCUITRY FOR REDUCING THE MUTUAL INFLUENCE OF PIXELS CONNECTED TO SELECTION ADDRESS CONDUCTORS

This is a continuation of application Ser. No. 08/519,559, filed Aug. 25, 1995, now abandoned.

BACKGROUND OF THE INVENTION

1. Field of the Invention

The invention relates to a display device provided with a liquid crystal display panel (LCD) having sets of row address conductors and column address conductors coupled to liquid crystal pixels in a matrix of rows and columns, and a drive circuit for driving the liquid crystal display panel, the drive circuit comprising a pixel drive circuit comprising a selection drive circuit for presenting selection voltages to a first set of address conductors, a data drive circuit for presenting data voltages to a second set of address conductors in dependence upon a received data, and a voltage correction circuit coupled for receiving a correction signal and a power supply voltage and for supplying a corrected power supply voltage to the pixel drive circuit, and to a drive circuit for driving such a liquid crystal display panel.

Such liquid crystal display panels are suitable for displaying alphanumerical or video information.

The invention also relates to a driving method.

2. Description of the Related Art

A drive circuit of this type is known from EP-A-0 523 796, corresponding to U.S. patent application Ser. No. 08/187,364, filed Jan. 26, 1994. The known drive circuit is adapted to drive an LCD in which liquid crystal pixels (hereinafter referred to as pixels) are arranged in series with two-terminal non-linear devices. The series arrangement of the pixels and the two-terminal non-linear devices is arranged between selection and data address conductors. A display condition of the pixels is determined by a voltage difference between the selection and data address conductors, and a voltage drop across the non-linear elements. In this case, a row drive circuit supplies row selection voltages for the selection address conductors, and a column drive circuit supplies a video drive of the data address conductors of the LCD. A video processing unit processes presented video information to video signals suitable for the column drive circuit. A timing of processing operations in the row and column drive circuits is controlled by a pulse generator. The row and column drive circuits receive power supply voltages from a power supply circuit.

The video signals are simultaneously presented to all columns by the column drive circuit per row (or line), while the row drive circuit selects the correct row. Together with the row selection voltage, the video signals cause the pixels in a selected row to obtain the desired display condition which is subsequently maintained until the next selection of the relevant row. The polarity of a voltage across the pixels is regularly inverted (for example, per frame) so as to prevent degradation of the pixels.

The known drive circuit further comprises a current measuring circuit for generating a correction voltage which is related to a current measured in at least one of the selection address conductors during a measuring period, and a voltage correction circuit for modulating at least one of the power supply voltages, in dependence upon the correction voltage, for compensating (slow) variations of threshold characteristics of the two-terminal non-linear devices. Since the current is slightly influenced by the video signals, a component related to the video signals occurring during the measuring period is removed from the correction voltage in one of the embodiments. The known drive circuit provides compensation for a variation of the threshold characteristics of the two-terminal devices so as to achieve a satisfactory uniformity of a displayed video image. The known drive circuit does not reduce the mutual influence of the pixels in a row.

SUMMARY OF THE INVENTION

It is, inter alia an object of the invention to provide a drive circuit for reducing the mutual influence of pixels coupled to one and the same selection address conductor, which mutual influence occurs as a result of charge or discharge currents of the pixels via a common impedance in series with the selection address conductor.

To this end, a first aspect of the invention provides a display device as set forth in the opening paragraph, characterized in that the drive circuit further comprises an averaging circuit for supplying the correction signal in dependence upon an average value of an information signal which is in conformity with the data signal during an averaging period which is related to a line period of the information signal.

A second aspect of the invention provides a method of driving a liquid crystal display panel via sets of row address conductors and column address conductors which are coupled to liquid crystal pixels arranged in a matrix of rows and columns for displaying images, said method comprising the steps of generating selection voltages to be supplied to a first set of address conductors; generating data voltages to be supplied to a second set of address conductors, which data voltages are related to a received display information signal; and generating at least one power supply voltage corrected in dependence upon a correction signal for influencing voltages to be supplied to at least one of the sets of address conductors, characterized in that the correction signal is generated as an average value of an information signal related to the received display information signal over an averaging period which is related to a line period of the information signal.

A third aspect of the invention provides a drive circuit for driving a liquid crystal display panel having sets of row address conductors and column address conductors coupled to liquid crystal pixels in a matrix of rows and columns, and a drive circuit for driving the liquid crystal display panel, the drive circuit comprising a pixel drive circuit comprising: a selection drive circuit for presenting selection voltages to a first set of address conductors, and a data drive circuit for presenting data voltages to a second set of address conductors in dependence upon a received data signal, a voltage correction circuit coupled for receiving a correction signal and a power supply voltage and for supplying a corrected power supply voltage to the pixel drive circuit, characterized in that the drive circuit further comprises an averaging circuit for supplying the correction signal in dependence upon an average value of an information signal which is in conformity with the data signal during an averaging period which is related to a line period of the information signal.

Large LCD panels, having large dimensions of pixels or a large number of pixels per selection address conductor, have a large total capacitance per selection address conductor. This total capacitance, consisting of a sum of the separate capacitances of the pixels coupled to one of the selection address conductors, is also dependent on a modulated voltage difference presented to data address conductors and occurring across the pixels, the voltage difference being modulated with information voltages which are related to an information signal. The information signal may be, for example, a video signal or data-graphic information. A value of a total charge or discharge current to be supplied by a selection drive circuit to one of the selection address conductors coupled thereto will thus depend on the value of the total capacitance, on the value of a selection voltage present at the selection address conductor, and on the information voltages.

Output stages of the selection drive circuit and, coupled thereto, terminals of the selection address conductors, and power supply selection voltages used by the selection drive circuit, each have an impedance which is present between a desired unloaded power supply selection voltage and the selection address conductor. For the sake of simplicity, this impedance may be considered to be a series impedance between each output stage and the selection address conductor coupled thereto. An unwanted voltage drop caused by the value of the total charge or discharge current of the pixels coupled to the selection address conductor is produced across this series impedance. This results in selection voltages which are dependent on the information voltages presented to the pixels coupled to the same selection address conductor, so that these pixels mutually influence one another.

To elucidate this mutual influence, an LCD having crossed polarizers for displaying video images will hereinafter be taken as an example, in which the LCD, at the data address conductors, receives a first video line of picture signals consisting of picture signal elements having a medium grey luminance value (further referred to as medium grey picture signal elements). The next video line comprises a large number of picture signal elements for which a minimum passage of light is desirable (further referred to as black picture signal elements), while the rest of the video line comprises medium grey picture signal elements again. It will be assumed that each of the picture signal elements is imaged on exactly one pixel of the LCD. Since more voltage is required for black picture signal elements and, moreover, the capacitance of the pixels is larger than for pixels to which medium grey picture signal elements are presented, more current will be required for charging or discharging the capacitances associated with these black picture signal elements. Due to this larger current, the selection voltages decrease to a larger extent as a result of a larger unwanted voltage loss across the series impedance, and the medium grey picture signal elements will be less charged or discharged than is intended and they will thus be displayed in a lighter tint than in the previous line.

The invention is based on the recognition that a charge transport having a value of:

$$Q=C*2*V,$$

occurs when a pixel having a capacitance C is reversed in voltage, for example, from a voltage −V to a voltage +V, and that the capacitance of a pixel for voltages between a threshold voltage Vth and a saturation voltage Vsat of the pixel can be approximated by:

$$C = C\text{min} \text{ for } V \leqq Vth$$

$$C = C\text{max} - (C\text{max} - C\text{min})*Vth/V \text{ for } Vth \leqq V \leqq Vsat.$$

Here, Cmax is the theoretically maximum capacitance of a pixel which would be produced at an infinitely large voltage across the pixel, and the saturation voltage is defined as the voltage at which the transmission of a pixel has decreased to a given final level, for example 1%. Said charge transport can then be written as:

$$Q=2*Cmax*V-2*(Cmax-Cmin)*Vth.$$

The charge transport appears to be directly proportional to a voltage V across the pixel. For a row of pixels, the total charge transport is then proportional to the sum of separate voltages across all pixels. This also applies to the current through the series impedance and the unwanted voltage drop related thereto.

A compensation of said mutual influence is possible by averaging the information signal by means of an averaging circuit during a period of time (the averaging period) related to a line period of the information signal, and by correcting, dependent on a drive mode of the LCD, one or more selection voltages supplied by a power supply circuit by means of a correction signal thus obtained. The period of time related to the line period of the information signal may be related, for example, to a selection period in which the pixels coupled to a selected selection address conductor receive the information voltages from the data address conductors. The selection period may be substantially equal to the period of time related to the line period. The selection period may alternatively be, for example, one-half, or one-third of the period of time related to the line period.

It will be evident that the same reasoning applies to LCDs having non-crossed polarizers, provided that a transmission/voltage characteristic of a pixel is inverted: a high voltage across a pixel provides a white pixel (maximum transmission of light) instead of a black pixel.

In accordance with one of the known drive modes, the selection drive circuit for the selection address conductors may generate a four-level selection voltage consisting of a charge voltage during a selection period and followed by a hold voltage having the same polarity but a lower value during a hold period which lasts until the next selection period. The polarity of the charge voltage and the hold voltage is inverted in consecutive frames. The absolute value of the charge voltages has been chosen to be so high that the two-terminal non-linear devices behave as closed switches with which the pixels are charged and discharged via the data address conductors during the selection period, dependent on the charge voltages and the information signal. The absolute value of the hold voltages has been chosen to be such that the two-terminal non-linear devices behave as open switches, to maintain the charge applied to the pixels during the selection period till the next selection period. Due to the symmetry of the charge and hold voltages, of a current/voltage characteristic of the two-terminal non-linear devices, and of the transmission/voltage characteristic of the pixels, the inverted and non-inverted charge voltages have the same influence on a display condition of the pixels and both are corrected by means of the correction signal.

The row drive circuit may also generate a five-level selection voltage, in which a reset voltage is generated before the start of one of the charge voltages of a four-level drive mode. Such a known drive of the selection address conductors is necessary when unidirectional two-terminal non-linear devices are used. In other words, a transmission/voltage characteristic of bidirectional two-terminal non-linear devices is used in one direction so that a possible non-symmetry of the transmission/voltage characteristic does not have any influence on the display condition. For a maximum compensation of said crosstalk, both charge voltages may be corrected. If the value of the reset voltage is chosen to be just sufficient to completely recharge the pixels, a minimum current will be required in the next selection period so as to charge the pixels to voltage values associated with the information signal, and the unwanted voltage drop across the series impedance will have little influence. It has been found that it is sufficient in this case to correct only the charge voltage which is not preceded by a reset pulse.

Passive liquid crystal display panels do not comprise two-terminal non-linear devices so that charging or discharging of the pixels proceeds so rapidly that the charge or discharge current in the selection address conductor reaches a final value of zero before an end of the selection period, so that an unwanted voltage drop is no longer present across the series impedance. After the selection period, the desired charge voltage is thus present across the pixels. However, the rate at which the pixels are charged and discharged will be lower due to an initial unwanted voltage drop if the series impedance is larger. The display condition of the pixels depends on an average voltage across these pixels, so that a larger series impedance will result in a lesser drive of the pixels. Since the unwanted initial voltage drop depends on the total charge and discharge current in the selection address conductor, the mutual influence of the display condition of pixels occurs again. A compensation of the mutual influence is now also possible by correcting the charge voltage by means of the correction signal. The correction signal is now also generated by averaging the information signal by means of an averaging circuit during a period of time (the averaging period) related to the line period of the information signal.

These and other aspects of the invention will be apparent from and elucidated with reference to the embodiments described hereinafter.

DESCRIPTION OF THE PREFERRED EMBODIMENTS

Figure 1A:
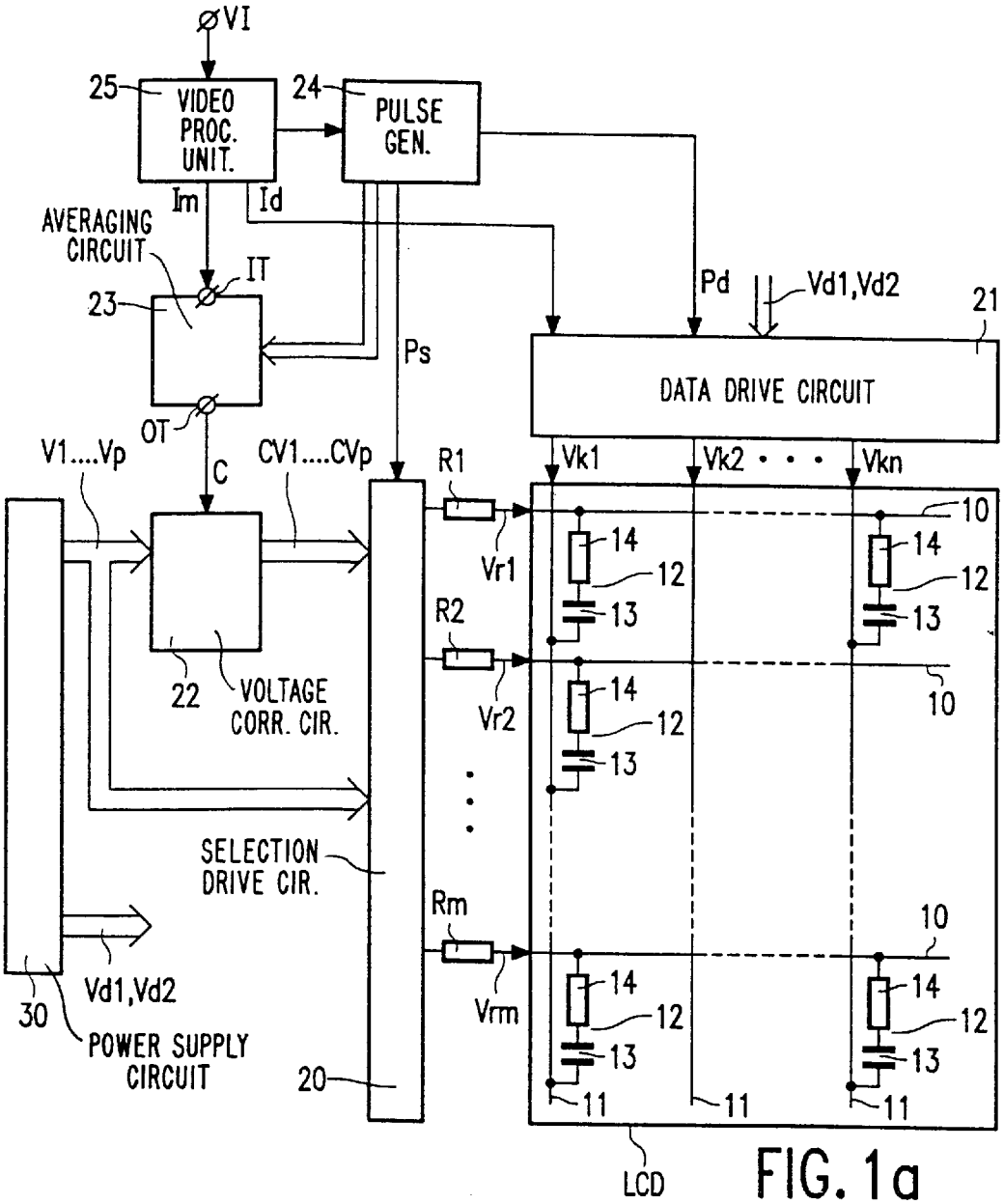
FIG. 1*a* shows a picture display device provided with a drive circuit for an LCD according to the invention.
Figure 1B:
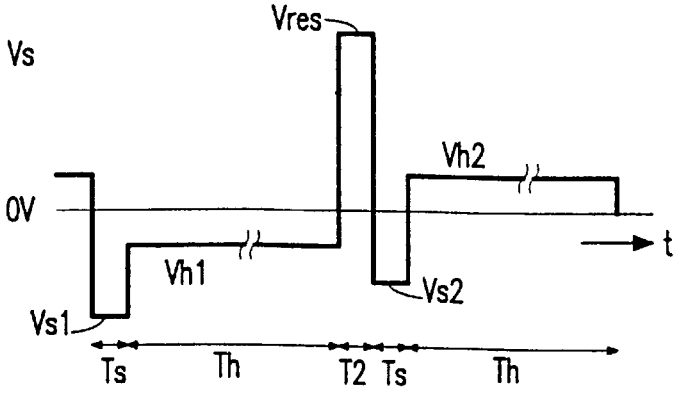
FIG. 1*b* shows a possible variation of power supply selection voltages.

FIG. 1 shows a picture display device for displaying picture information VI (for example, video images or datagraphic information) and is provided with a liquid crystal display panel LCD and an averaging circuit 23 according to the invention. The liquid crystal display panel LCD comprises m rows each having n pixels 12. Each pixel 12 comprises a twisted nematic liquid crystal element (further referred to as TN element) 13 shown as a capacitor and arranged electrically in series with a bidirectional non-linear resistive element (further referred to as NLR element) 14 having a threshold characteristic and behaving as a switching element between a row address conductor 10 and a column address conductor 11. The pixels 12 are addressed via sets of the row and column address conductors 10 and 11 consisting of electrically conducting lines provided on facing surfaces of two spaced glass supporting plates (not shown) on which also the facing electrodes of the TN elements 13 are arranged. The NLR elements 14 are provided on the same plate as the set of row address conductors. For a passive liquid crystal display panel LCD, the pixels 12 do not comprise NLR elements 14.

The row address conductors 10 are used as selection electrodes and are addressed by a selection drive circuit 20 which generates selection voltages Vr. The selection voltages Vr comprise a charge voltage Vs for sequentially selecting the row address conductors 10 in dependence upon selection pulses Ps generated by a pulse generator 24. Under the control of data pulses Pd generated by the pulse generator 24, data voltages Vk are presented synchronously with the selection voltages Vr by a data drive circuit 21 to the column address conductors 11. A video processing unit 25 processes the image information VI to first and second information signals Im and Id which are in conformity with each other and are suitable for the averaging circuit 23 and the data drive circuit 21, and supplies synchronizing signals to the pulse generator 24. The image information VI may be displayed by selecting successive row address conductors 10 and by simultaneously presenting data voltages Vk related to lines of the image information VI to the column address conductors 11. The averaging circuit 23 averages the first information signal Im over an averaging period which is related to a line period of the first information signal Im for a selected row address conductor 10 under the control of control pulses P from the pulse generator 24, and supplies a correction signal C to a voltage correction circuit 22, this correction signal being related to an average value thus determined. The period of time related to the line period of the first information signal Im may be related, for example, to a selection period in which the selection voltage Vs is presented to the selected row address conductor 10. The selection period may be substantially equal to the period of time related to the line period. The selection period may alternatively be, for example, one-half or one-third of the period of time related to the line period.

Embodiments of the averaging circuit will be further described with reference to FIGS. 2 and 3. A power supply circuit 30 generates power supply selection voltages V1, . . . , Vp for the selection drive circuit 20 and power supply voltages Vd1, Vd2 for the data drive circuit 21. For a five-level drive mode of the row address conductors 10, five power supply selection voltages V1, . . . , V5 are generated for the row address conductors 10, which is shown, by way of example, in FIG. 1*b*.

The first power supply selection voltage V1 is the first charge voltage Vs1 which brings the NLR elements 14 connected to the selected row address conductor 10 to a low-ohmic state, during a selection period Ts, in which state these elements may be considered to be closed switches. The TN elements 13 in series with the NLR elements 14 are now selected for discharging (or charging, dependent on the polarity chosen) with a difference between the first charge voltage Vs1 and the data voltages Vk.

The second power supply selection voltage V2 is the first hold voltage Vh1 which brings the NLR elements 14 connected to the selected row address conductor 10 to a high-ohmic state, during a hold period Th, in which state these elements may be considered to be open switches, while TN elements 13 in series therewith are decoupled from the row address conductor 10 and are thus no longer influenced by the data voltages Vk. The selection period Ts is often one (or one-half) line period of the image information VI, and the hold period Th usually covers one frame period. During the hold period Th, the other row address conductors are selected one by one.

The third power supply selection voltage V3 is the reset voltage Vres which brings the NLR elements 14 connected to the row address conductor 10 to a low-ohmic state during a reset period Tr, which is often equal to the selection period Ts, in which state, these elements may be considered to be closed switches. The value of the reset voltage Vres is chosen to be sufficiently high to charge the TN elements 13 which are in series with the NLR elements 14 (or to discharge them, dependent on the chosen polarity of the reset voltage Vres) to above their saturation voltage Vsat (with which the TN elements 13 produce a minimum light transmission if the LCD comprises two crossed polarizers).

The fourth selection voltage V4 is the second charge voltage Vs2 which brings the NLR elements 14 connected to the row address conductor 10 to the low-ohmic state during the selection period Ts, in which state these elements may be considered to be closed switches. The TN elements 13 in series with the NLR elements 14 are then selected for discharging (or charging) with the difference between the second charge voltage Vs2 and the data voltages Vk. The TN elements 13 are provided with charge in the same direction by the first and the second charge voltage Vs1 and Vs2 so that, each time, the same half of the transmission/voltage characteristic of the TN elements 13 is used.

The fifth power supply selection voltage V5 is the second hold voltage Vh2 which brings the NLR elements 14 connected to the row address conductor 10 to a high-ohmic state again during the hold period Th, in which state, these elements may be considered to be open switches, while TN elements 13 in series therewith are decoupled and are thus no longer influenced by the data voltages Vk.

Output stages of the selection drive circuit 20, terminals of the selection address conductors 10 coupled thereto, and power supply selection voltages V1, . . . , V5 used by the selection drive circuit 20, each have an impedance which is present between a desired unloaded power supply selection voltage and the selection address conductor 10. For the sake of simplicity, this impedance may be considered to be a series impedance R between each of the output stages and the selection address conductors 10 coupled thereto. An unwanted voltage drop caused by the value of the total charge or discharge current of the pixels 12 coupled to the selection address conductor 10 is produced across this series impedance R. This results in selection voltages Vr which are dependent on the data voltages Vk presented to the pixels 12 coupled to the same selection address conductor 10, so that these pixels 12 mutually influence each other.

For a maximum compensation of said crosstalk, the two charge voltages Vs1, Vs2 can be corrected in dependence upon the correction signal C. If the value of the reset voltage Vres is chosen to be just sufficient to fully recharge the TN elements 13, a minimum current will be necessary in the next selection period Ts for charging the TN elements 13 to voltage values associated with the data voltages Vk. In this case, it is sufficient to correct only the charge voltage Vs1 which is not preceded by a reset voltage Vres. In a four-level drive mode of the row address conductors 10, four power supply selection voltages V1, . . . , V4 are generated for the row address conductors 10, which voltages consecutively consist of the first charge voltage Vs1, the first hold voltage Vh1, the second charge voltage Vs2 and the second hold voltage Vh2. For compensating said crosstalk, the two charge voltages Vs1, Vs2 are corrected in dependence upon the correction signal C. The voltage correction circuit 22 thus receives one or more selection voltages V1, . . . , Vp and supplies one or more related corrected selection voltages CV1, . . . , CVp to the selection drive circuit 20. The selection voltages V1, . . . , Vp which do not require correction can be presented to the selection drive circuit 20 directly or via the voltage correction circuit 22.

It is alternatively possible to modulate the power supply voltages Vd1 and/or Vd2 per row instead of the selection voltages V1, . . . , Vp by means of the correction signal C. Alternatively, the data drive circuit 21 can be rendered suitable for correcting the data voltages Vk by the same but opposite amount.

Figure 2:
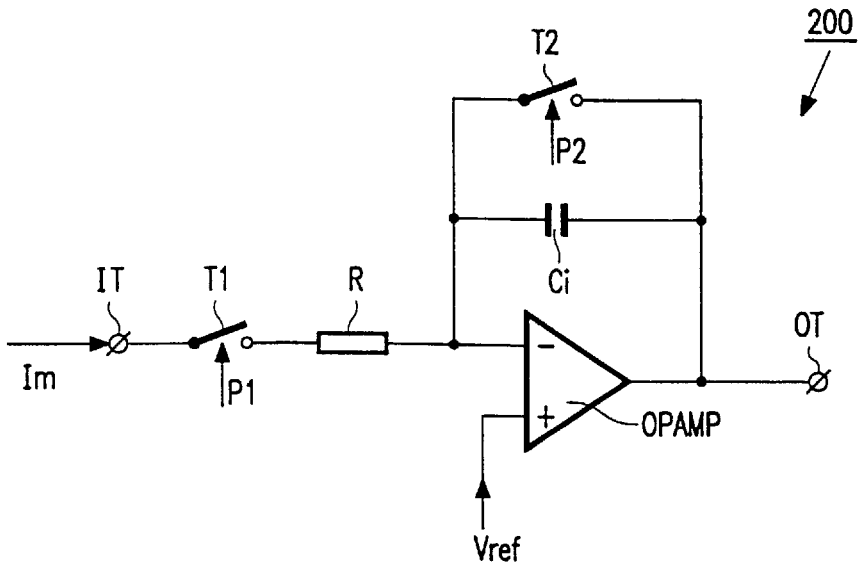
FIG. 2 shows a first embodiment of the averaging circuit according to the invention.

FIG. 2 shows a first embodiment of the averaging circuit 23 according to the invention. The averaging circuit 23 receives an analog first information signal Im (for example, a luminance signal comprising red, green and blue signal components) at an input terminal IT and supplies the correction signal C at an output terminal OT. The averaging circuit 23 is provided with a known analog integrator, here comprising an operational amplifier OPAMP, a non-inverting input of which is connected to a reference voltage Vref and an inverting input is connected to a junction point of a first terminal of a resistor R, a first terminal of a second switching element T2 and a first terminal of a capacitor Ci. A second terminal of the resistor R is connected to a first terminal of a first switching element T1, and a second terminal of the first switching element T1 is coupled to the input terminal IT. A junction point of a second terminal of the second switching element T2, a second terminal of the capacitor Ci and an output of the operational amplifier OPAMP is coupled to the output terminal OT. Moreover, the pulse generator 24 has a first output which is coupled to a drive terminal of the first switching element T1 for supplying a first drive pulse P1 which closes the first switching element T1 during the averaging period, and a second output which is coupled to a drive terminal of the second switching element T2 for supplying a second drive pulse P2 which closes the second switching element T2 until the start of the averaging period. Until the start of the averaging period (generally the start of a charge voltage Vs1, Vs2), the capacitor Ci is maintained discharged by the closed second switching element T2. At the start of the averaging period, the second switching element T2 is opened and the first switching element T1 is closed. At the end of the averaging period, the capacitor Ci is charged to a voltage level which is representative of the average value of the analog first information signal Im during the averaging period. Transistors may be uses as switching elements T1 and T2.

Figure 3:
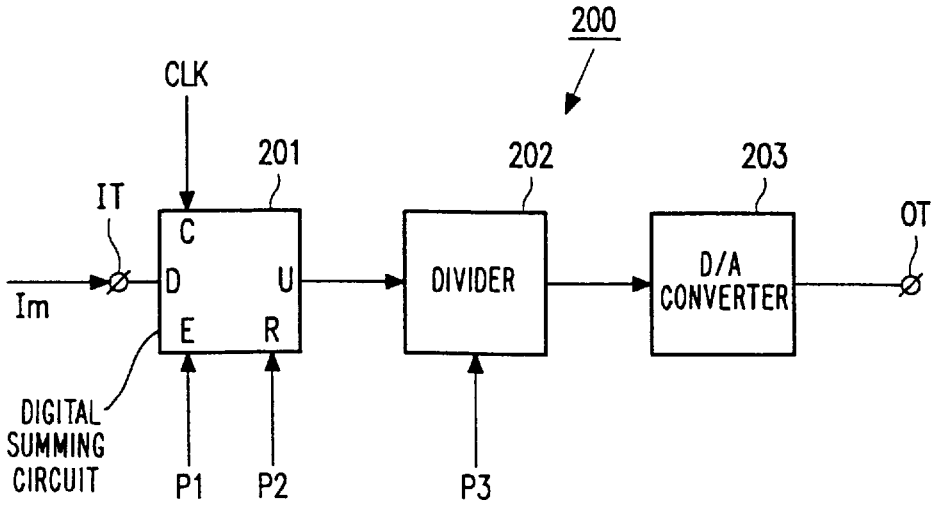
FIG. 3 shows a second embodiment of the averaging circuit according to the invention.

FIG. 3 shows a second embodiment of the averaging circuit according to the invention. The averaging circuit 23 receives a digital first information signal Im (for example a series of digital words representing an 8-bit grey level signal) at an input terminal IT and supplies the correction signal C at an output terminal OT. The averaging circuit 23 comprises a digital summing circuit 201 which has a data input D coupled to the input terminal IT, a clock input C for receiving a clock signal CLK, an enable input E for receiving a first pulse P1, a reset input R for receiving a second pulse P2, and a summing output U. The summing output U is coupled to a first input of a divider circuit 202. The divider circuit 202 has a second input for receiving a third pulse P3 and an output coupled to an input of a D/A converter 203. The output of the D/A converter 203 is coupled to the output terminal OT. The pulse generator 24 has a first output which is coupled to the clock input C for supplying a clock signal CLK, a second output which is coupled to the enable input E for supplying the first drive pulse P1 which causes the summing circuit to be active during the averaging period, a third pulse which is coupled to the reset input R for supplying the second drive pulse P2 which resets the summing circuit to an initial value before the start of a subsequent averaging period, and a fourth output which is coupled to the second input of the divider circuit 202 for activating the divider circuit 202 after termination of the averaging period. Before the start of the averaging period (generally the start of a charge voltage Vs1, Vs2), the summing circuit 201 is set to an initial value (for example, zero) by the second drive pulse P2. At the start of the averaging period, the first drive pulse P1 becomes active and the summing circuit 201 starts summing. At the end of the averaging period, the sum of all digital words is available at the summing output U. The divider 202 is then activated by the third drive pulse P3 and supplies a digital number which is converted by means of the D/A converter 203 to an analog voltage which is representative of the average value of the digital first information signal Im during the averaging period. Instead of the three drive pulses P1, P2, P3, it is alternatively possible to use one pulse, a rising edge of which activates the summing circuit 201, for example, at the start of an averaging period (the enable input E is activated at a high level and the reset input R is activated at a low level), and a falling edge activates the divider 202 at the end of the averaging period, and subsequently resets the summing circuit 201, possibly via a delay.

It is to be noted that the embodiments described hereinbefore illustrate rather than limit the invention and that those skilled in the art will be able to conceive many alternative embodiments without departing from the protective scope of the appendant claims.

The use of the invention appeared to have a particularly favorable effect in liquid crystal display panels (LCDs) provided with two-terminal non-linear devices 14 having a less steep current/voltage characteristic. Such two-terminal non-linear devices 14 are used, for example, in thin-film diode and reset (TFD-R) liquid crystal display panels (LCD).

I claim:

1. A display device provided with a liquid crystal display panel having sets of row address conductors and column address conductors coupled to liquid crystal pixels in a matrix of rows and columns, and a drive circuit for driving the liquid crystal display panel, the drive circuit comprising:

a pixel drive circuit comprising a selection drive circuit for presenting selection voltages to a first set of address conductors, and a data drive circuit for presenting data voltages to a second set of address conductors in dependence upon a received data signal to be displayed;

an averaging circuit having an input for receiving an information signal which is in conformity with the received data signal to be displayed, said averaging circuit supplying an averaged value of the information signal during an averaging period which is related to one line period of the information signal; and a voltage correction circuit coupled to receive the averaged value and at least one power supply voltage for supplying at least one corrected power supply voltage to the pixel drive circuit, wherein said voltage correction circuit directly modulates said at least one power supply voltage with said averaged value thereby forming said at least one corrected power supply voltage varying in accordance with said averaged value.

2. A display device as claimed in claim 1, characterized in that the averaging circuit comprises an integrator circuit.

3. A display device as claimed in claim 2, characterized in that the integrator circuit is provided with an operational amplifier, a non-inverting input of which is connected to a reference voltage and an inverting input is connected to a junction point of a first terminal of a resistor, a first terminal of a switch and a first terminal of a capacitor, a second terminal of the resistor being connected to a first terminal of a switching element and a second terminal of the switching element being coupled for receiving an analog information signal, a junction point of a second terminal of the switch, a second terminal of the capacitor and an output of the operational amplifier is coupled to an output terminal, and in that the drive circuit further comprises a pulse generator having a first output which is coupled to a drive terminal of the switching element for supplying a first drive pulse which closes the switching element during the averaging period, and a second output which is coupled to a drive terminal of the switch for supplying a second drive pulse which closes the switch after termination of the averaging period and opens said switch before a start of the averaging period.

4. A display device as claimed in claim 2, characterized in that the integrator circuit is provided with a digital summing circuit having a data input for receiving the information signal comprising a series of digital words, a clock input for receiving a clock signal, an enable input for receiving a first pulse, a reset input for receiving a second pulse and a summing output for supplying a sum value, the summing output being coupled to a first input of a divider circuit for dividing the sum value by a fixed number, the divider circuit having a second input for receiving a third pulse and an output which is coupled to an output terminal, and in that the drive circuit further comprises a pulse generator having a first output which is coupled to the clock input, a second output which is coupled to the enable input for supplying the first drive pulse which activates the digital summing circuit during the averaging period, a third output which is coupled to the reset input for supplying the second drive pulse which, prior to the averaging period, resets the digital summing circuit to an initial value, and a fourth output for supplying the third pulse which activates the divider circuit after termination of the averaging period.

5. A method of driving a liquid crystal display panel via sets of row address conductors and column address conductors which are coupled to liquid crystal pixels arranged in a matrix of rows and columns for displaying images, said method comprising the following steps:

generating selection voltages to be supplied to a first set of address conductors;

generating data voltages to be supplied to a second set of address conductors, said data voltages being related to a received display information signal to be displayed;

generating an averaged value of an information signal over an averaging period which is related to one line period of the information signal, said information signal being in conformity with the received display information signal to be displayed; and generating at least one power supply voltage corrected in dependence upon the averaged value for influencing voltages to be supplied to at least one of the sets of address conductors, wherein said at least one power supply voltage is directly modulated with said averaged value thereby forming said at least one corrected power supply voltage varying in accordance with said averaged value.

6. A method of driving a liquid crystal display panel as claimed in claim 5, characterized in that the determination of the averaged value of the information signal comprises the following steps:

receiving the information signal comprising a series of digital words;

resetting, under the control of a reset pulse before a start of the averaging period, a sum value of the series of digital words to an initial value;

determining, during an active period of an enable pulse, the sum value of the series of digital words under the control of a clock signal, which active period is the averaging period; and dividing the sum value by a fixed number under the control of an action pulse after termination of the averaging period.

7. A drive circuit for driving a liquid crystal display panel having sets of row address conductors and column address conductors coupled to liquid crystal pixels in a matrix of rows and columns, the drive circuit comprising:

a pixel drive circuit comprising a selection drive circuit for presenting selection voltages to a first set of address conductors, and a data drive circuit for presenting data voltages to a second set of address conductors in dependence upon a received data signal to be displayed;

an averaging circuit having an input for receiving an information signal which is in conformity with the received data signal to be displayed, said averaging circuit supplying an averaged value of the information signal during an averaging period which is related to one line period of the information signal; and a voltage correction circuit coupled to receive the averaged value and at least one power supply voltage, said voltage correction circuit supplying at least one corrected power supply voltage to the pixel drive circuit, wherein said voltage correction circuit directly modulates said at least one power supply voltage with said averaged value thereby forming said at least one corrected power supply voltage varying in accordance with said averaged value.

* * * * *